United States Patent [19]

Jenkins

[11] 3,942,754

[45] Mar. 9, 1976

[54] MOLD FOR MAKING MAGNETIC BASE

[75] Inventor: William A. Jenkins, Englewood, Ohio

[73] Assignee: Monarch Marking Systems, Inc., Dayton, Ohio

[22] Filed: Jan. 23, 1975

[21] Appl. No.: 543,382

Related U.S. Application Data

[60] Division of Ser. No. 448,774, March 6, 1974, Pat. No. 3,885,498, which is a continuation-in-part of Ser. No. 87,673, Nov. 9, 1970, Pat. No. 3,885,497.

[52] U.S. Cl. ..... 249/84; 249/96

[51] Int. Cl.[2] ..... B22D 19/00

[58] Field of Search ..... 249/84, 95, 108, 151, 164, 249/85, 81, 177, 184, 160, 119, 122, 123, 129, 130; 425/130, 192, 247, 248, 185

[56] References Cited

UNITED STATES PATENTS

| | | | |
|---|---|---|---|
| 3,000,053 | 9/1961 | Hart | 425/145 |
| 3,355,772 | 12/1967 | Kolberg | 249/151 X |
| 3,463,221 | 8/1969 | Tillery | 249/129 |
| 3,771,322 | 11/1973 | Betschart | 425/130 X |
| 3,836,111 | 9/1974 | Binder | 249/164 X |
| 3,865,343 | 2/1975 | Jenkins | 249/95 |

*Primary Examiner*—R. J. Shore
*Assistant Examiner*—John S. Brown
*Attorney, Agent, or Firm*—Joseph J. Grass

[57] ABSTRACT

There is disclosed a magnetic printing base for one or more printing plates, a method of making the magnetic base, and a mold in which moldable, non-magnetic adhesive material is molded about various parts of the magnetic base. The base is structured to permit magnetic circuit devices and end plates to be interconnected by the non-magnetic material into a unitary arrangement. Each magnetic circuit device includes a flat magnet disposed between and in contact with a pair of flat magnetizable plates. The permanent magnetsextend short of the final desired dimension of the base. The plates and the molded material initially extend beyond the final desired dimension of the base, but are trimmed off by a cutter to the final desired dimension after assembly of the base. To obviate the tendency of the printing plate to creep or drift, the spacing between the magnetic circuits is such that the strength, at surface of the base, of the magnetic flux field between next adjacent pole plates of adjacent magnetic circuit devices is equal to the strength, at the surface of the base, of the magnetic flux field between the pole plates of a magnetic circuit device itself.

There is also disclosed a method of making a magnetic printing base by stages, as is desirable when molding a large base with a material that tends to set in a relatively short period of time, a mold therefor, and improved magnetic bases.

3 Claims, 15 Drawing Figures

FIG-1
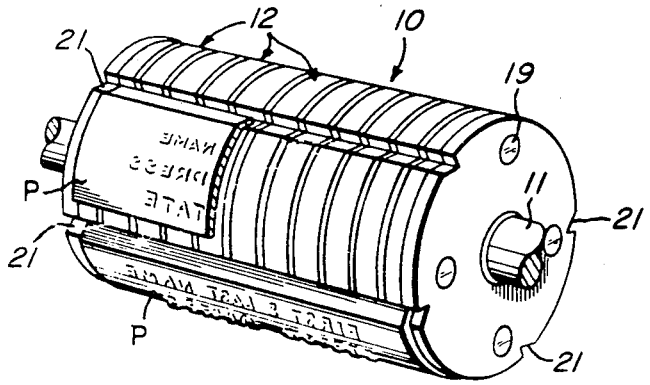
FIG-2
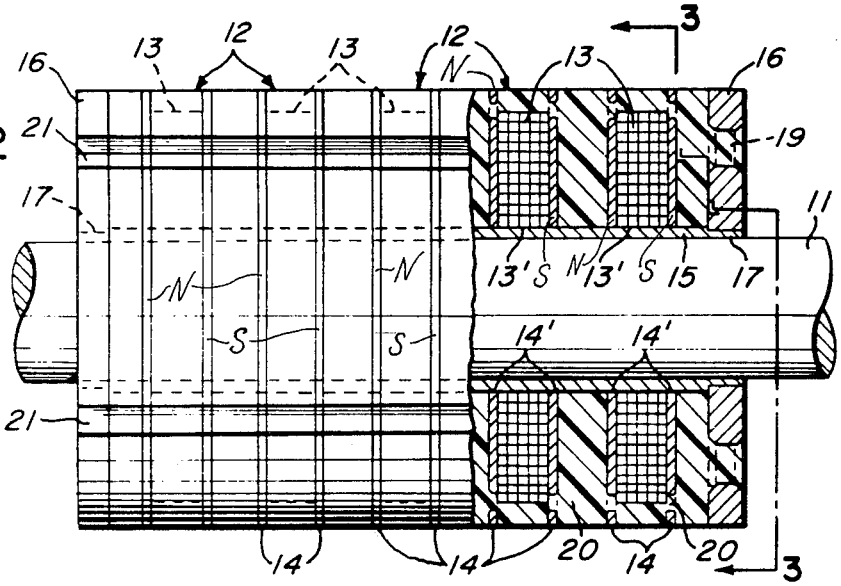
FIG-3
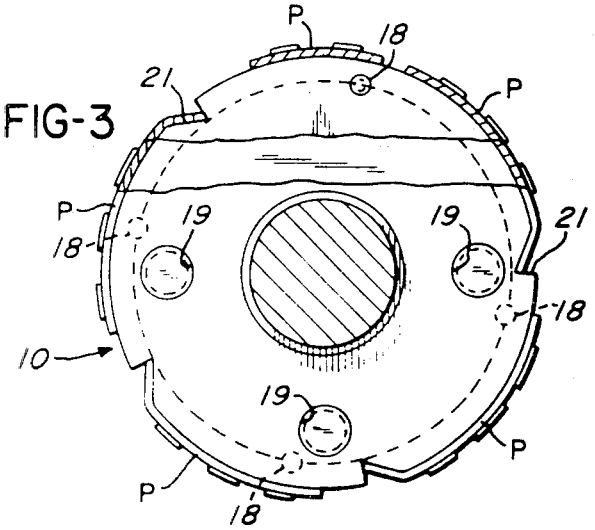
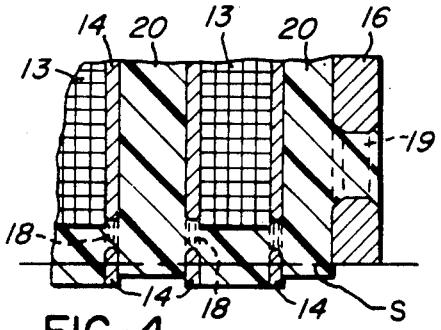
FIG-4

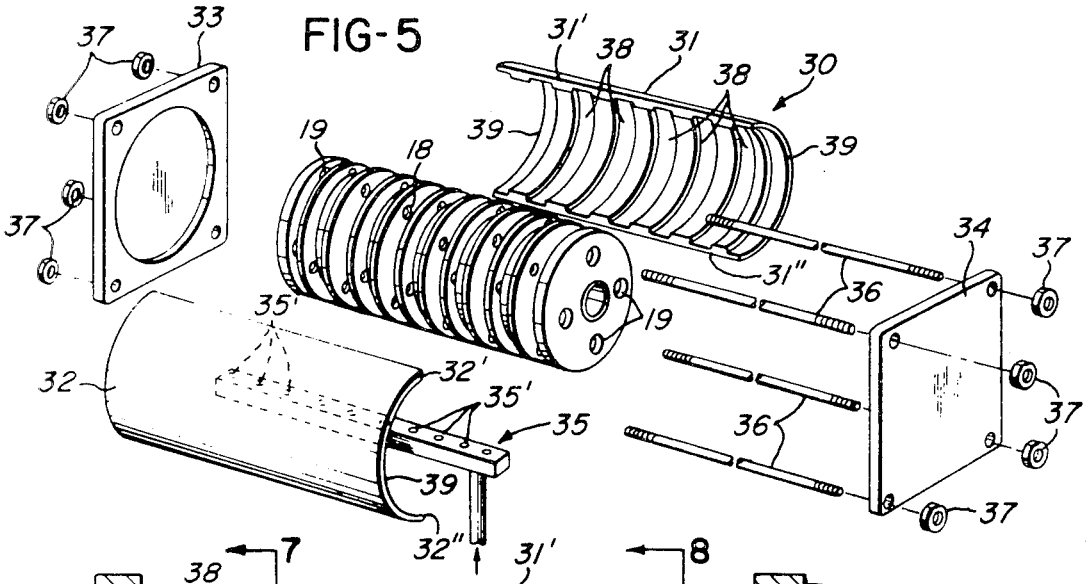
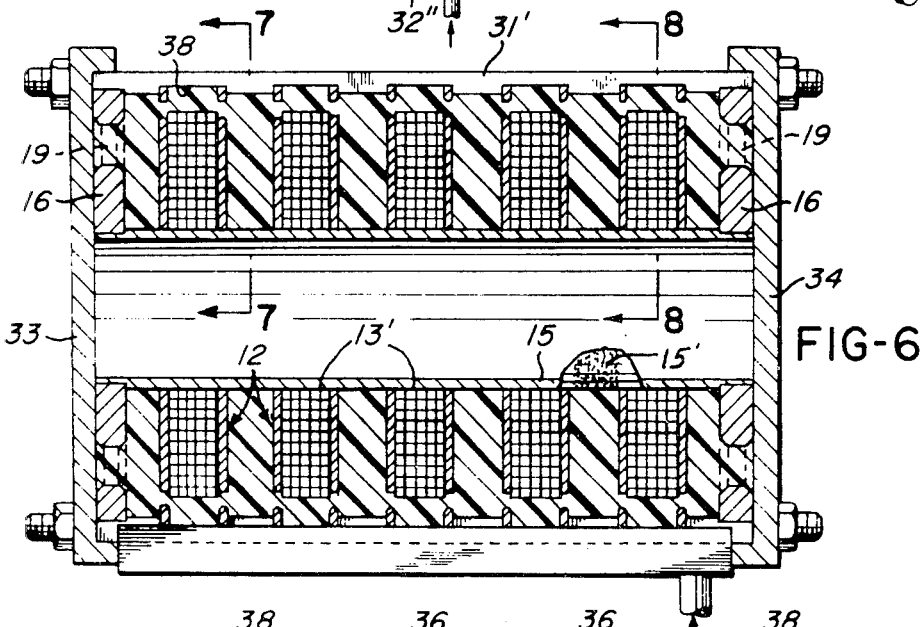
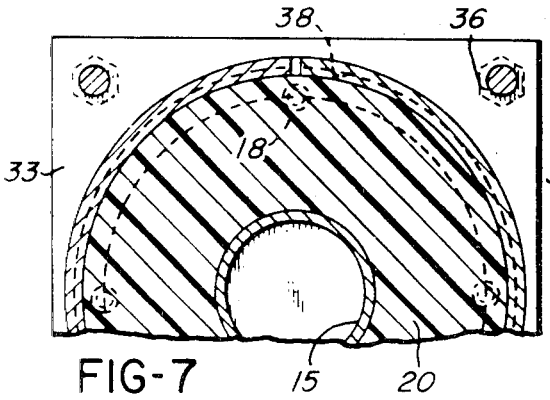
FIG-7
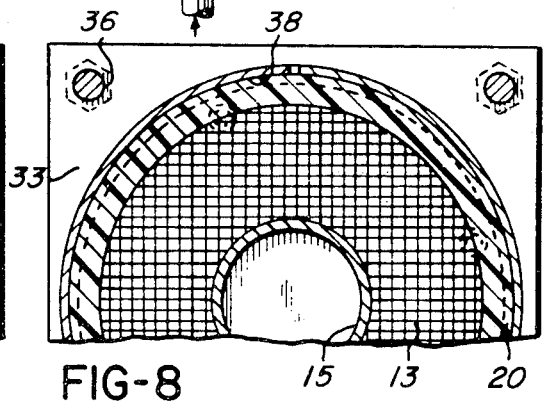
FIG-8

MOLD FOR MAKING MAGNETIC BASE

CROSS-REFERENCE TO RELATED APPLICATIONS

This is a division of application Ser. No. 448,774, filed Mar. 6, 1974 and now U.S. Pat. No. 3,885,498 which is a continuation-in-part of application Ser. No. 87,673, filed Nov. 9, 1970 and now U.S. Pat. No. 3,885,497. Reference is also made to application Ser. No. 422,400, filed Dec. 6, 1973 and now U.S. Pat. No. 3,865,343, which is a division of application Ser. No. 87,673.

BACKGROUND OF THE INVENTION

This invention relates to the art of magnetic printing bases, and methods of and molds for making same. There are numerous prior art patents relating to magnetic bases and the like; example are U.S. Pat. Nos. 1,657,287, 2,481,191, 2,952,205, 2,992,733, 3,024,392, 3,027,835, 3,039,390, 3,086,461, 3,097,598, 3,180,259 and 3,509,819 and British Pat. No. 933,666.

SUMMARY OF THE INVENTION

According to the present invention, a unitized magnetic printing base is formed by providing an elongated member, placing at least two spaced-apart magnet means and a partition on the elongated member so that the partition is disposed in the space between adjacent magnet means to define separate zones, and flowing moldable material into empty spaces in the zones by stages. It is advantageous to mold the base in stages when using a material which sets in a relatively short period of time such as epoxy or polyester material, particularly when the base is of a large diameter and/or is long. Some large magnetic bases are known to be over seven inches in diameter and to be several feet in length. One specific embodiment of the invention comprises providing an elongated member, placing at least two spaced-apart magnetic circuit means and a partition on the elongated member so that the partition is disposed in the space between adjacent magnetic circuit means, the plates and the partition having diameters greater than the final desired diameter of the base and the magnet means extending short of the final desired diameter, placing the elongated member with the magnetic circuit means and the partition in a cavity of a mold such that the partition divides the cavity into zones, flowing non-magnetic moldable material into the zones by stages to fill the remaining empty spaces in the zones by stages to beyond the final desired diameter, and trimming off the portions of the plates and the partition beyond the final desired diameter.

Another specific embodiment of the invention comprises providing an elongated member, placing at least two spaced-apart magnetic circuit means on the elongated member, each magnetic circuit means including magnet means disposed between a pair of magnetizable plates, placing the elongated member with the magnetic circuit means in a cavity of a mold, at least some but less than all of the plates partitioning the cavity into zones, and flowing non-magnetic moldable material into the zones in stages. The invention also comprises a method whereby two or more bases can be made in stages. The invention also comprises improved printing bases and a mold in which the base structure can be unitized.

BRIEF DESCRIPTION OF THE DRAWINGS

FIG. 1 is a perspective view of a magnetic base for printing plates;

FIG. 2 is a side elevational view, partly in section, of the magnetic base shown in FIG. 1;

FIG. 3 is a sectional view taken generally along line 3—3 of FIG. 2;

FIG. 4 is an enlarged fragmentary sectional view showing a portion of the magnetic base as it appears during one of the manufacturing steps;

FIG. 5 is an exploded perspective view of a mold in which the magnetic base can be molded;

FIG. 6 is a vertical sectional view of the mold, showing the magnetic base in the mold after the moldable material has filled the mold;

FIG. 7 is a sectional view taken generally along line 7—7 of FIG. 6;

FIG. 8 is a sectional view taken generally along line 8—8 of FIG. 6;

DETAILED DESCRIPTION OF THE PREFERRED EMBODIMENT

Figures 9, 10, 11, 12, 13, 14, 15:
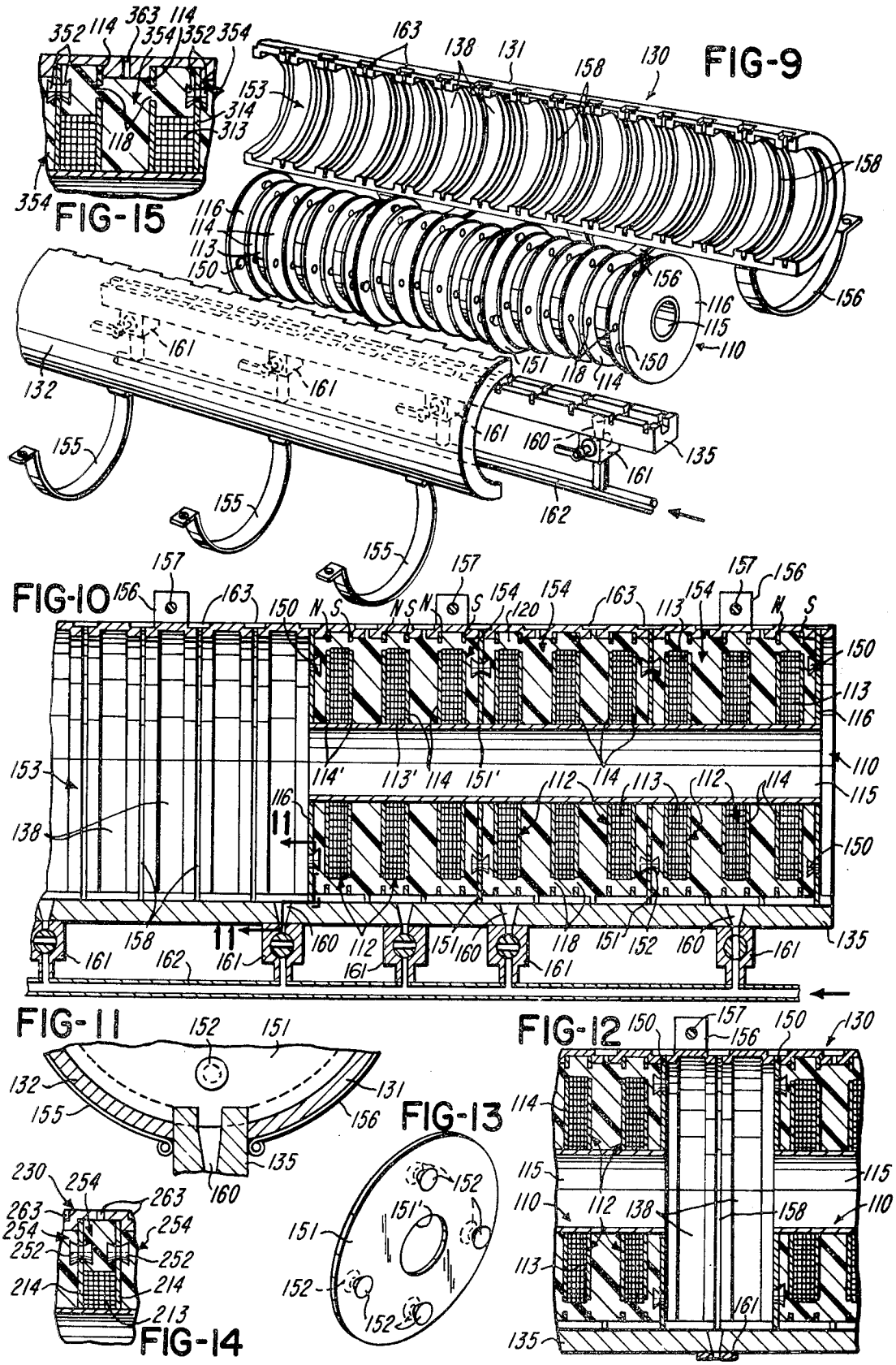
FIG. 9 is an exploded perspective view of a mold and a fragmentary portion of a magnetic printing base in accordance with the present invention.
FIG. 10 is a vertical sectional view of the mold, showing the magnetic base in the mold with the moldable material having filled the zones in the mold cavity.
FIG. 11 is a sectional view taken along line 11—11 of FIG. 10.
FIG. 12 is a vertical sectional view similar to FIG. 12, but showing the manner in which a plurality of printing bases can be molded in the same mold.
FIG. 13 is a perspective view showing one of the plates.
FIG. 14 is a fragmentary sectional view of another embodiment showing magnetizable plates having stud-like keying means.
FIG. 15 is a fragmentary view of yet another embodiment showing the use of a combination of two different varieties of keying means.

With particular reference to FIGS. 1, 2, and 3, there is shown a magnetic base in the form of a printing cylinder or drum generally indicated at 10 mounted on shaft 11. The base 10 can be secured to and driven by the shaft 11 or the base 10 can be rotatable ith respect to the shaft 10 and driven by other means, as desired. The magnetic base 10 is illustrated as including a plurality of spaced apart permanent magnetic circuit devices generally indicated at 12. Each magnetic circuit device 12 includes a flat, annular, permanent magnet 13 and a pair of magnetizable pole plates 14. Each magnet has a central hole 13' and each plate 14 has a central hole 14'. A cylindrical mounting member 15 in the form of a sleeve is shown to pass through the holes 13' and 14' and forms a flux path for each of the magnetic circuits. The plates 14 and the member 15 are composed of magnetizable, easily machinable material such as low carbon steel. End plates 16 are received about reduced portions 17 of the mounting member 15 at locations spaced apart from the endmost magnetic circuit devices 12. The magnetic circuit devices 12 are all constructed with equal strength; the magnets 13 are of the same size and composition and the pole plates 14 are of the same size and composition. The magnets 13 are so arranged that alternate pole plates 14 are poled north-south-north-south, and so on, in a direction longitudinally of the base 10 as indicated by N and S in FIG. 2. Accordingly, the next adjacent pole plates 14 of adjacent magnetic circuit devices 12 are of opposite polarity. In accordance with the invention, the distance between adjacent magnetic circuit devices 12 is not arbitrary, but rather it is established by spacing the magnetic circuit devices 12 apart by a distance at which the magnetic flux field strength between next adjacent hole plates 14 of adjacent magnetic circuit devices 12 are equal, or substantially so, to the magnetic flux field strength of the magnetic circuit devices 12 themselves. Once the spacing has been established for a magnetic base having circuit devices of a particular size, strength, material and configuration, any number of such bases can be constructed using the same spacing.

The external diameters of the magnets 13 are less than the external diameter of the base 10 whereas the plates 14 extend all the way to the final surface of the magnetic base 10. Each of the plates 14 has four equally spaced apart holes 18 near its periphery. The holes 18 extend at least partly beyond the associated magnets 13. The end plates 16 have four spaced apart apertures or holes 19 which are larger in diameter than the holes 18 in the plates 14. Moldable, non-magnetic, adhesive material 20, such as epoxy fills: the space between the magnets 13 and the surface of the base 10 between associated plates 14, the spaces between the outer surface of the cylinder member 15 and the outer surface of the base between plates 14 of adjacent magnetic circuit devices 12, the spaces between the plates 14 of the endmost magnetic circuit devices and the associated end plates 16 between the cylindrical member 15 and the surface of the base 10, and the holes 18 and 19 in respective plates 18 and 19. The magnetic base 10 is accordingly formed into a unitary support structure in which a magnetizable printing plate or a printing plate having a magnetizable holding portion is held to the base 10 by magnetic attraction, and in addition, the plates 14 and the non-magnetic material 20 serve to provide a solid support for the printing plate or plates. To assure adequate keying of the material 20 to the member 15, the outer surface of the member 15 between the next adjacent plates 14 of adjacent magnetic circuit devices 12, and between the plates of endmost circuits 12 and associated end plates 16 is roughened at annular zones 15. A fragmentary portion of one of these zones 15' is shown in FIG. 6. Roughening can be accomplished by knurling or any other suitable means.

With reference to FIGS. 1 and 3, printing plates P constructed at least in part of magnetizable material are shown held onto the base 10 by magnetic attraction. The base 10 is shown to be provided with four longitudinally extending slots or grooves 21 in its periphery. The slots 21 cut through the end plates 16, the non-magnetic material 20, and the plates 14. Leading edges of four of the printing plates are shown to be received in the grooves 21 which prevents the printing plates P from creeping around the base 10 as its rotates during the printing operation. The grooves 21 are preferably milled into the base 10 by a milling cutter (not shown).

With particular reference to FIG. 4, there is shown in exaggerated form, the manner in which plates 14 initially extend beyond the final desired surface S' of the base 10. In the particular embodiment of a base 10 of cylindrical form illustrated in the drawings, the plates 14 initially extend beyond the final desired surface S' and in particular have a larger diameter than the final diameter of the base 10. It has been found to be most economical to eliminate close tolerances by sizing the plates 14 larger than necessary and allowing wide positive tolerances, and by sizing the magnets 13 smaller than necessary and allowing wide tolerances. As one of the final steps in the manufacturing operation, the base 10 is turned on a lathe by rotating the base 10 in conventional manner relative to a cutter which moves at a predetermined rate of feed in a direction longitudinally with respect to the base 10, thereby removing material 20 and the portions of the plates 14 radially beyond the final desired surface S' of the base 10.

With reference to FIGS. 5–8, there is shown a mold generally indicated at 30 which is useful in performing the molding step of the invention. The mold 30 is shown to include a pair of mold sections 31 and 32 and a pair of end plates 33 and 34. The mold sections 31 and 32 are curved and extend through arcs of about 170° each. The mold section 31 has side edges 31' and 31'', and the mold section 32 has side edges 32' and 32''. When the mold is assembled side edges 31'' and 32'' of the respective mold sections 30 and 31 are in liquid-tight abutment with an elongated nozzle 35, and there is a gap between the side edges 31' and 32' as best shown in FIGS. 7 and 8. A plurality of tie rods 36 cause the end plates 33 and 34 to exert clamping pressure on the ends of the mold sections 31 and 32 when nuts 37 are tightened.

Each of the mold sections 31 and 32 has a plurality of positioning and holding grooves 38 formed at its inside surface. These grooves 38 extend in an arcuate direction between the respective side edges 31' and 31'' and 32' and 32''. Assuming that a circular cylindrical printing base is to be fabricated, a circular cylindrical member 15 shown to take the form of a sleeve is provided. Then plates 14 and magnets 13 can be assembled into the member 15 either individually or as sets or groups of magnet circuits. In the illustrated embodiment, one magnetic circuit comprises a permanent magnet 13 disposed between and in contact with a pair of plates 14. If the magnetic circuits are to be assembled as sets the attractive force of the magnet 13 will hold the associated magnetizable plates 14 to it and hence each magnetic circuit is easily moved into position by sliding the magnetic circuit into the member 15. In the illustrated embodiment the magnetic circuits 12 are shown to be spaced apart. As the magnets 13 have a diameter which is intentionally less than the final diameter of the base 10 and the plates 14 having a diameter greater than the final diameter of the base 10, the accuracy of the outer surface of the base 10 is not dependent upon accurate sizing or location of the holes 13' and 14'. Accordingly, holes 13' and 14' are acceptable even though larger than necessary by a considerable tolerance.

Endmost grooves 39 in the mold sections 31 and 32 are shown to receive end plates 16. The grooves 38 have a width which is slightly greater than the combined thicknesses of two plates 14 and the magnet 13 so that during the molding operation the magnetic circuits 12 are not apt to be displaced by the moldable material. Here again accuracy of positioning the magnetic circuits 12 is not necessary. With the components which are to comprise the base 10 disposed within the mold and the mold in the clamped condition as shown in FIG. 6, the moldable, non-magnetic adhesive material is forced into the mold through orifices 35' in the nozzle 35. As the material enters the mold, air escapes through the gap between side edges 31' and 32' of the mold sections 31 and 32. As the magnets 13 and the associated plates 14 have flat sides, the moldable material does not flow between the contacting surfaces. However, material is able to flow into the spaces between plates 14 of adjacent magnetic circuits 12, into the space around the magnets 13 and between the associated plates 14, between the plates 14 of the endmost magnetic circuits 12 and the end plates 16, into and through holes 18 in the plates 14, and into holes 19 in the end plates 16, thereby providing a unitized base. As the moldable material, preferably in the form of epoxy gradually fills the spaces described above until excess non-magnetic material flows into the gap between side edges 31' and 32' at the time flow of additional material into the mold through the nozzle 35 is interrupted and the moldable material is allowed to set and harden. After the material 20 sets and hardens, the mold 30 is removed with respect to the base 10 and the base 10 is ready to be turned on a lathe.

If desired, many of the benefits of the base 10 can be achieved by applying the invention to a flat bed type of magnetic base. In that event the final desired surface of the base 10 can be achieved by using a milling cutter (not shown). The milling cutter would make passes relative to the base 10 in the same direction as the direction in which the plate and magnets extend.

With reference to FIGS. 9 and 10, there is shown a magnetic base 110. Magnetic circuit devices 112 are shown to include flat, annular, permanent magnets 113 between and in contact with a pair of magnetizable pole plates 114. Each magnet 113 has a central hole 113' and each plate 114 has a central hole 114'. An elongated cylindrical mounting member 115 in the form of a sleeve is shown to pass through holes 113' and 114' and forms a flux path for each of the magnetic circuit devices 112. The plates 114, end plates 116, and the member 115 are composed of magnetizable, easily machinable material such as low carbon steel. End plates 116 are received about the end portions of the mounting member 115. The magnetic circuit devices 112 are all constructed with equal strength; the magnets 113 are of the same size and composition and the pole plates 114 are of the same size and composition. The magnets 113 are so arranged that the pole plates 114 are poled north-south-north-south, and so on in a direction longitudinal of the base 110 as indicated by N and S in FIG. 10. The devices 112 are spaced apart by a distance at which the magnetic flux field strength between adjacent pole plates 114 of adjacent magnetic circuit devices 112 are equal, or substantially so, to the magnetic flux field strength of the magnetic circuit devices 112 themselves, at the surface of the base 110. The external diameters of the magnets 113 are less than the final external diameter of the base 110 whereas the plates 114 extend all the way to the final surface of the magnetic base 110 when the base 110 has been trimmed. Each of the plates 114 has four equally spaced-apart holes 118 near its periphery. The holes 118 extend at least partly beyond the associated magnets 113. The end plates 116 have keying means in the form of four equally spaced apart studs 150. Partitions 151 have respective holes 151' through which the elongated member 115 extends. The partitions 151 are shown to comprise flat, imperforate plates. The partitions 151 have keying means in the form of four equally spaced-apart studs 152 on its opposite faces. The studs 152 are undercut to promote better keying than in the event straight studs were to to be used. The end plates 116 and the partitions 151 divide cavity 153 to mold 130 into a plurality of zones 154 which can be selectively filled with any suitable moldable material, by way of example not limitation, epoxy or polyester material 120. Thus, the base 110 can be molded in sections. The mold 130 has a pair of identical mold sections 131 and 132. The mold sections 131 and 132 are in liquid-tight abutment with an elongated trough 135. Clamp members 155 and 156 are hinged to the trough 135 and can be tightened and loosened by any suitable means such as screws 157. Each of the mold sections 131 and 132 has a plurality of positioning and holding grooves 138 and 158 formed at its inside surface. The plates 114 and 116 and the partitions 151 can be assembled into member 115 either individually or as sets or groups of magnetic circuit devices 112, with one or more devices 112 disposed between a set of partitions 151, and with one or more devices 112 disposed between an end plate 116 and a partition 151. As the magnets 113 have a diameter which is intentionally less than the final desired diameter of the base 110, and the plates 114 and 116 and the partitions 151 have diameters greater than the final diameter of the base, the accuracy of the outer surface of the base 110 is not dependent upon accurate sizing or location of the holes 113', 114' or 151'. Accordingly, holes 113', 114' and 151' are acceptable even though larger than necessary by a considerable tolerance.

The partitions 151 fit into positioning and holding grooves 158 in the mold sections 131 and 132. As best seen in FIG. 11, the partitions 151 enter the trough 135 and stop off the flow of moldable material between zones 154. Inlets 160 communicate with the trough at spaced apart locations. A plug valve 161 is connected to each inlet 160, and a conduit 162 is connected to each valve 161. In accordance with the invention, individual zones 154 can be selectively filled with the moldable material in stages. For example, the empty space of one zone 154 can be completely filled with moldable material by opening the respective valve 161, and thereafter that valve 161 can be closed and the empty space of another zone can be completely filled by opening the respective valve 161, and so on until the entire base 110 is unitized. Air vent holes 163 allow the escape of air from the zones 154 in the mold 130. When all the moldable material has hardened, the base 110 can be removed from the mold, and in the manner illustrated in FIG. 4, the moldable material 120, the plates 114 and 116 and the partitions 151 can be trimmed off to provide the desired final diameter. Trimming can be effected for example by turning the base 110 on a lathe. The partitions 151 and studs 152 are preferably composed of non-magnetic, easily machinable material such as aluminum.

It is apparent that the mold 130 can be constructed to make any desired length of base 110. One or more partitions 151 can be provided depending upon the volume of the empty space in the zones and the length of setting time of the moldable material. Although three magnetic circuit devices 112 are shown in each zone 154, one, two or more than three can also be provided. In view of these variables, it is sometimes desirable to effect staging by filling more than one zone 154 at one time, or to start filling one zone before another zone has been completely filled.

As illustrated in FIG. 12, two (or more) bases 110 can be unitized at one time in a single mold utilizing partitioning. As is apparent the bases 110 are not keyed or otherwise connected to each other. The valves 161 can be staged to provide filling of the zones 154 one at a time, or at selected rates of fill, or if desired, all the bases can be filled simultaneously.

In the embodiment of FIG. 14, no partitions, such as the partitions 151 are used in that pole plates 214 are themselves partitions, but in this event mold 230 must be provided with an inlet for the moldable material between each such partition and a corresponding vent hole 263 provided to allow for the escape of air. In other respects the mold 230 is the same as the mold 130. Studs 252, for example four in number, are provided to effect keying. Each pole plate 214 is like the pole plate 14 except that plates 214 are imperforate and hence do not allow for the through-flow of the moldable material.

In the embodiment of FIG. 15, which is identical to the embodiment of FIGS. 9, 10, 11, 12 and 13 except as noted below, some of the pole plates 314 are also partitions. The other pole plates 114 are perforate, like pole plates 14. Holes 118 effect keying with the moldable material as to studs 352.

In the embodiments of FIGS. 14 and 15, the end plates (not shown) are like end plates 116. As is apparent, each respective zone 254 and 354 has an inlet for moldable material and an air vent hole 263 and 363.

It is preferred to use one-piece magnets 13, 113, 213 and 313 although segmented or other shape magnets can be employed, if desired, within the spirit of the invention.

While it is most preferable to also key the member 115 to the remainder of the base in the embodiments of FIGS. 9 through 15 as by roughening 15' (FIG. 6), it is feasible to omit this roughening, to coat the outer surface with mold release compound and remove the member 115 following molding.

Other embodiments and modifications of this invention will suggest themselves to those skilled in the art, and all such as these as come within the spirit of this invention are included within its scope as best defined by the appended claims.

I claim:

1. A mold assembly for making a circular cylindrical magnetic base having an elongated member and spaced-apart magnetic circuit means disposed on the elongated member, the mold assembly comprising: a plurality a sections arranged to define a generally cylindrical mold cavity, the cavity being capable of receiving the elongated member and the magnetic circuit means, means forming part of the completed magnetic base for partitioning the cavity into zones, the partitioning means preventing moldable material from flowing from one zone to another during the molding operation, the partitioning means keying the moldable material of adjacent zones together to provide a unitary magnetic base, and means for selectively introducing moldable non-magnetic material into the empty spaces of the zones by stages.

2. A mold assembly as defined in claim 1, wherein the means for selectively introducing the material comprises a valve individual to each zone.

3. A mold assembly as defined in claim 1, wherein the means for selectively introducing the material comprises a trough, the partitioning means extending into the trough to close off passage of the moldable magnetic material in the trough at the partitioning means.

* * * * *